United States Patent [19]

Laursen et al.

[11] Patent Number: 4,520,547

[45] Date of Patent: Jun. 4, 1985

[54] FLANGING OF PLASTIC LINED CONDUIT

[75] Inventors: Larry J. Laursen, Midland; Elton D. Prueter, Saginaw, both of Mich.

[73] Assignee: The Dow Chemical Company, Midland, Mich.

[21] Appl. No.: 466,452

[22] Filed: Feb. 15, 1983

[51] Int. Cl.[3] ..... B21D 39/00; B21B 17/02

[52] U.S. Cl. ..... 29/469.5; 29/523; 72/370; 285/55

[58] Field of Search ..... 29/458, 469.5, 512, 29/523; 264/249; 285/55; 72/367, 370

[56] References Cited

U.S. PATENT DOCUMENTS

| | | | |
|---|---|---|---|
| 3,200,479 | 8/1965 | Peterson | 285/55 X |
| 3,742,590 | 7/1973 | Douglas | 29/523 |
| 3,833,984 | 9/1974 | Dietzel | 29/523 X |

*Primary Examiner*—Charlie T. Moon

*Attorney, Agent, or Firm*—R. B. Ingraham

[57] ABSTRACT

Plastic lined pipe with the lining adhered to the pipe is flanged such as by a hydraulic operation. Resultant flanged pipe does not require heat treatment.

4 Claims, 2 Drawing Figures

FLANGING OF PLASTIC LINED CONDUIT

Figure 1:
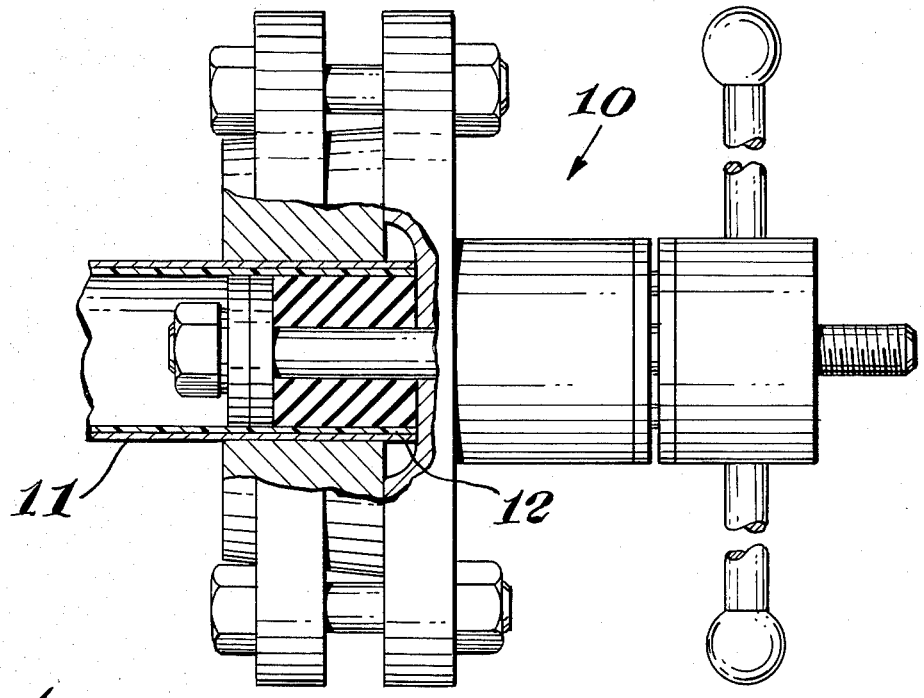

In many instances it is desirable to employ a conduit having a synthetic resinous lining either for purposes of corrosion resistance or for isolating the material being conveyed from a metal conduit. Lined conduit offers the corrosion resistance and isolation from metallic bodies while employing an outer metallic member to provide the desired resistance against deformation caused by internal pressure, and provide a desired rigidity at elevated operating temperatures. Synthetic resinous or plastic linings are provided to conduit by a variety of methods. One method is to apply a slightly undersized liner to metallic conduit and expand the liner to contact the inner surface of the conduit. Another technique is to utilize a synthetic resinous plastic liner which is somewhat less in diameter than the inner diameter of the metallic conduit in which it is to be disposed. The metallic conduit is then swaged about the plastic liner to provide a conduit of a desired size. Another technique of lining a metal conduit with a thermoplastic material or an elastomeric material, is to stretch the plastic conduit until it has a diameter smaller than that of the inside diameter of the conduit being lined, subsequently inserting the liner into the conduit and releasing the axial tension causing the stretching of the conduit, and thereby being held within the external metal conduit. Metallic conduits having a synthetic resinous liner are joined in a variety of fashions. One particularly desirable method of joining heavy walled lined conduits is to remove terminal portions of the outer metal conduit permitting the liner to extend beyond the metallic conduit, affixing a flange to the metallic conduit, heating the extending liner portion and molding against the flange applied to the metallic conduit.

A variety of techniques are employed to form a generally radially extending flange on the synthetic resinous conduit in such a manner that it conforms to the flange of the metallic conduit. Deformation is frequently done after heating of a thermoplastic liner and either mechanically deforming the liner to conform to the conduit or hydraulically deforming the liner to conform to the metallic flange of the metallic conduit. In certain instances, malleable metallic conduits are employed which may be readily hydraulically deformed from flanges from the terminal portions thereof. Usually in forming such a flange, a suitable hydraulic forming tool is applied to one end of the conduit and the liner and metallic conduit forced generally radially outwardly to form a flange, the flange comprising a portion of the metallic conduit as well as a portion of the synthetic resinous liner. On release of the hydraulic pressure employed to form the flange, usually the synthetic resinous thermoplastic flanged portion exhibits the phenomenon of springback. The liner flange portion separates from the flange portion of the metallic conduit and forms a generally frustoconical configuration which generally is conformed to the metallic flange by heating the frustoconical portion of the liner and mechanically forcing it against the metallic flange until the flange of the liner cools and maintains a generally radially outwardly planar configuration. Thus flanging of such conduit requires two steps, the initial flanging of the metallic liner conduit and the subsequent heat setting or molding of the plastic liner to conform to the flange of the metallic conduit. A wide variety of techniques and tools are available for the formation of the flanges on terminal portions of synthetic resinous lined conduit. Some of such techniques are set forth in the following U.S. Pat. Nos. 2,823,418; 2,907,103; 3,013,310; 3,142,868; 3,253,449; 3,335,484; 3,341,894; 3,383,750; 3,390,442; 3,435,109; 3,448,491; 3,461,505; 3,742,590; 3,744,115; 3,828,823; 4,127,287; 4,302,183; along with U.S. patent application Ser. No. 404,026, filed Aug. 2, 1982; and Ser. No. 410,203 filed Aug. 23, 1982, the teachings of which are herewith incorporated by reference thereto.

It is an object of this invention to provide an improved method for the flanging of synthetic resinous lined metallic conduit.

It is also an object of this invention to provide an improved simplified one-step method for the preparation of flanged synthetic resinous lined conduits.

A further object of this invention is to provide a method for the flanging of synthetic resinous thermoplastic lined conduits wherein subsequent heat setting of the synthetic resinous liner is eliminated.

These benefits and other advantages in accordance with the present invention are achieved in a method for the preparation of a flanged synthetic resinous thermoplastic lined conduit, the steps of the method comprising providing a malleable metallic conduit having a malleable synthetic resinous liner, the synthetic resinous liner being adhered to the metallic conduit at least adjacent the terminal portions of the metallic conduit, deforming a terminal portion of the synthetic resinous lined conduit to form a generally outwardly extending radial flange thereon while maintaining adhesion of the plastic liner to the so formed flange portion.

FIG. 1 discloses a flanging apparatus generally designated by the reference numeral 10 having a plastic lined pipe 11 therein. The plastic lining of the pipe 11 is adhered to the external metal layer in an annular region generally indicated by the reference numeral 12.

Figure 2:
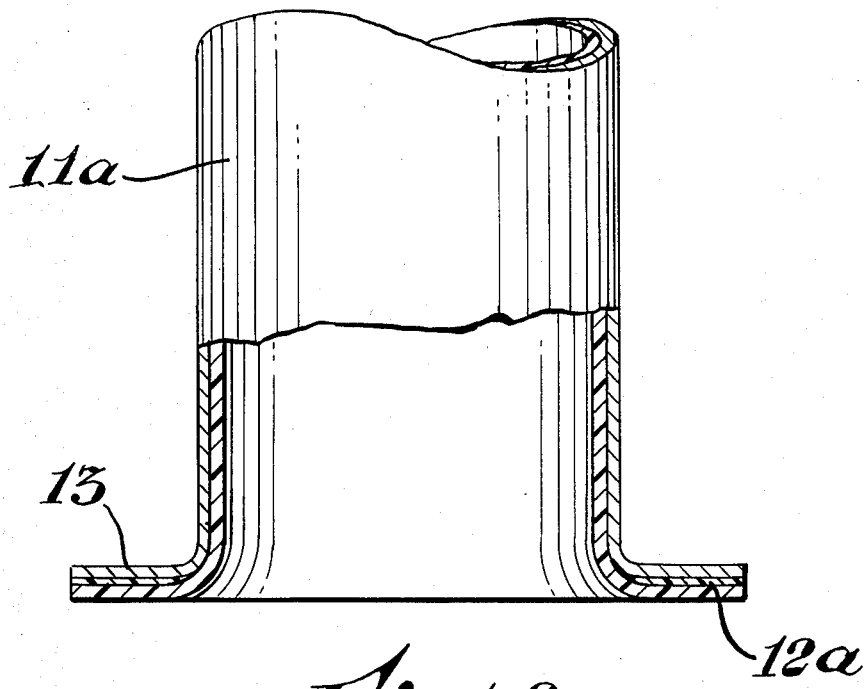

In FIG. 2 there is depicted a sectional fractional view of a plastic lined conduit 11 having a generally radially extending flange 13. In the region indicated by the reference numeral 12*a* there is disposed an adhesive.

Malleable metallic conduits useful in the practice of the present invention most commonly are of steel, generally low carbon steel, advantageously of thinner wall thickness, such as Schedule 10 and Schedule 20 steel pipe. Liners useful in the practice of the present invention generally are liners which are of a thermoplastic nature or of an elastomeric nature. Such liners to be useful in the practice of the present invention must be malleable and capable of deformation without fracture, forming the outwardly extending radial flange of both the metallic conduit and the synthetic resinous liner.

Synthetic resinous materials suitable for the liners are elastomers such as natural rubber, synthetic rubber, thermoplastic polymers, such as polytetrafluoroethylene, polypropylene, ethylene-propylene copolymers as well as a wide variety of copolymers well known to those skilled in the art of synthetic resinous lined conduits.

Due to the wide diversity of materials which may be employed as liner, the adhesive employed to adhere the liner to the metallic conduit must be selected accordingly. Generally different synthetic resinous lining materials require different adhesives. The adhesive must adhere the liner to the metallic conduit. In some instances, a single adhesive applied between the conduit and the metallic conduit and liner is adequate for the practice of the present invention whereas in other circumstances an adhesive which adheres to the liner may be utilized with a second adhesive which adheres readily to the metallic conduit, the two adhesives either adhering to themselves or to a third intermediate layer of an adhesive to provide the desired degree of bonding. Selection of the appropriate adhesive is readily done by cleaning a portion of a steel coupon having a composition like that of the metallic conduit or an external surface of the metallic conduit and subsequently applying a portion of liner material to the external surface of the conduit. In order to be satisfactory for the practice of the present invention, adhesion of the lining material to the metallic conduit is evaluated after the adhesive has hardened or set by peeling plastic material from the coupon or external surface of the conduit. To be satisfactory for the practice of the present invention, force required to separate the plastic material from the metal should be sufficient to maintain the liner flange against the metal flange when the liner and metal conduit are simultaneously flanged. When adequate adhesion is obtained, the liner may be adhered to the conduit by any one of a variety of techniques including that of adhering the entire liner to the conduit being utilized, or by injecting adhesive between the liner and the conduit adjacent the terminal portions of the conduit which are to be flanged. Such injection is usually readily accomplished by employing a hypodermic syringe and a hypodermic needle, inserting the needle between the conduit and the liner, and applying a desired amount of adhesive for a depth appropriate to the size of the flange being formed.

Alternatively, adhesive may be injected through small openings formed in the metallic conduit. For example, openings may be formed in the wall of the metallic conduit adjacent the terminal portions thereof, having a dimension of about 0.3 inches in diameter, and an appropriate adhesive injected through such openings to provide the desired degree of adhesion between the synthetic resinous liner and the metallic conduit.

By way of further illustration, a polypropylene liner was adhered to a one-inch diameter malleable steel conduit wherein the internal conduit was lined with a polypropylene liner having an outside diameter of one inch and a wall thickness of 0.065 inch. The liner and conduit were degreased, sand blasted and adhered together by a two-part adhesive commercially available under the trade designation Epoxy Patch 1105, manufactured by Hysol Division of The Dexter Corporation, Pittsburgh, California. The adhesive was mixed in accordance with package instructions and applied to the inner surface of the steel conduit and the outer surface of the polypropylene liner. The liner was then forced into the metal conduit with relative rotation between the liner and the conduit. The resulting test specimen was allowed to cure at room temperature for a period of 7 days. At the end of that period, the conduit and liner were simultaneously flared utilizing an elastomeric plug and apparatus generally as described in U.S. Pat. No. 3,744,115. The resultant flared conduit had the liner flange securely adhered to the metal conduit flange.

Similar beneficial results were obtained when the foregoing procedure was repeated employing a polytetrafluoroethylene liner. Advantageous results were also obtained when the adhesive employed was a one-part high peel epoxy adhesive available under the trade designation of Dexter Hysol EA9414.1, with both a polypropylene liner and a polytetrafluoroethylene liner.

Similar beneficial results are obtained when the method of the present invention is utilized with other deformable liners and conduit combinations.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A method for the preparation of a flanged synthetic resinous thermoplastic lined conduit, the steps of the method comprising providing a malleable metallic conduit having a malleable synthetic resinous liner, the synthetic resinous liner being adhered to the metallic conduit at least adjacent the terminal portions of the metallic conduit, deforming a terminal portion of the synthetic resinous lined conduit to form a generally outwardly extending radial flange thereon while maintaining adhesion of the plastic liner to the so-formed flange portion.

2. The method of claim 1 wherein the malleable metallic conduit is steel.

3. The method of claim 1 including the step of adhering a synthetic resinous liner to the conduit.

4. The method of claim 1 wherein a synthetic resinous liner is adhered to the metallic conduit with an epoxy resin adhesive.

* * * * *